US012612243B2

(12) United States Patent
Hoffman

(10) Patent No.: US 12,612,243 B2
(45) Date of Patent: Apr. 28, 2026

(54) HOPPER FOR A PHARMACEUTICAL COUNTER

(71) Applicant: Express Scripts Strategic Development, Inc., St. Louis, MO (US)

(72) Inventor: Robert E. Hoffman, Linden, IN (US)

(73) Assignee: Express Scripts Strategic Development, Inc., St. Louis, MO (US)

( * ) Notice: Subject to any disclaimer, the term of this patent is extended or adjusted under 35 U.S.C. 154(b) by 837 days.

(21) Appl. No.: 17/876,897

(22) Filed: Jul. 29, 2022

(65) Prior Publication Data

US 2024/0034551 A1 Feb. 1, 2024

(51) Int. Cl.
*B65D 88/26* (2006.01)
*B65D 90/58* (2006.01)
*B65D 90/62* (2006.01)

(52) U.S. Cl.
CPC ..... *B65D 88/26* (2013.01); *B65D 90/587* (2013.01); *B65D 90/623* (2013.01)

(58) Field of Classification Search
CPC .... B65D 88/26; B65D 90/587; B65D 90/623; A61J 1/03; G07F 17/0092
See application file for complete search history.

(56) References Cited

U.S. PATENT DOCUMENTS 4,235,563 A * 11/1980 Hine ..... B65G 53/60 406/33
4,247,019 A * 1/1981 Lerner ..... G01G 13/08 222/173
4,697,721 A 10/1987 Johnson
5,222,634 A * 6/1993 Hayes ..... G01F 11/282 222/413
5,638,417 A * 6/1997 Boyer ..... B65B 37/04 377/6
5,884,806 A * 3/1999 Boyer ..... A61J 7/02 221/9
6,253,953 B1 7/2001 Ishizuka
6,370,215 B1 4/2002 Pinto
6,390,280 B1 * 5/2002 Boyce ..... B41F 17/36 198/530
6,568,567 B2 5/2003 Mckenzie
7,125,204 B2 10/2006 Wysong
7,139,639 B2 * 11/2006 Broussard ..... G07F 11/62 221/9
RE40,453 E * 8/2008 Lasher ..... G07F 9/001 53/411
7,584,018 B2 * 9/2009 Shows ..... G07F 11/54 700/242
7,624,894 B2 12/2009 Gerold
(Continued)

*Primary Examiner* — Michael Collins
(74) *Attorney, Agent, or Firm* — Stinson LLP

(57) ABSTRACT

A hopper of a pharmaceutical counter comprises a housing defining an interior sized to hold a plurality of pharmaceuticals. The housing defines an outlet in communication with the interior that is sized and shaped to permit the plurality of pharmaceuticals to move therethrough. The hopper also includes a baffle supported by the housing and disposed in the interior. The baffle is disposed between upper and lower ends of the interior. The baffle is arranged to support a portion of the plurality of pharmaceuticals above the baffle when the plurality of pharmaceuticals is held in the interior of the housing. This relieves the head pressure of the pharmaceuticals at the outlet.

18 Claims, 8 Drawing Sheets

(56) References Cited

U.S. PATENT DOCUMENTS

| | | | | |
|---|---|---|---|---|
| 8,091,471 | B2 * | 1/2012 | Larsen | A21D 8/06 366/144 |
| 8,521,326 | B1 * | 8/2013 | Holtje | G07F 17/0092 221/12 |
| 8,597,458 | B2 * | 12/2013 | Taniguchi | A61F 13/15658 156/383 |
| 8,862,266 | B2 | 10/2014 | Van Ooyen | |
| 9,697,335 | B2 | 7/2017 | Joplin | |
| 9,913,559 | B2 | 3/2018 | Polter | |
| 10,303,854 | B2 | 5/2019 | Joplin | |
| 10,352,872 | B2 | 7/2019 | Chen | |
| 10,375,877 | B2 | 8/2019 | Behr | |
| 10,577,550 | B2 | 3/2020 | Chagnot | |
| 10,743,563 | B2 | 8/2020 | Mohammed | |
| 2003/0070725 | A1 | 4/2003 | Gershman | |
| 2005/0263537 | A1 * | 12/2005 | Gerold | G07F 11/62 221/124 |
| 2008/0259721 | A1 | 10/2008 | Nieves-Vazquez | |
| 2009/0218363 | A1 * | 9/2009 | Terzini | B65B 5/103 221/4 |
| 2012/0204730 | A1 * | 8/2012 | Larsen | A21C 1/06 99/334 |
| 2014/0150376 | A1 * | 6/2014 | Milton | B65B 1/04 221/124 |
| 2015/0360161 | A1 | 12/2015 | Walters | |
| 2016/0198678 | A1 | 7/2016 | Norris | |
| 2016/0271543 | A1 | 9/2016 | Vincent | |
| 2018/0318744 | A1 | 11/2018 | Reid | |
| 2023/0017452 | A1 * | 1/2023 | Mahar | A61J 1/03 |

* cited by examiner

HOPPER FOR A PHARMACEUTICAL COUNTER

FIELD

The present disclosure generally relates to pharmaceutical counters, and more particularly to a hopper of a pharmaceutical counter.

BACKGROUND

Pharmaceutical fulfillment systems process and fill a large number of prescriptions and prescription orders with pharmaceuticals. Such fulfillment systems may include automated dispensing systems that supply a specified quantity of pharmaceuticals to prescription containers. Automated dispensing systems typically include one or more pharmaceutical counters which automatically count and dispense a specific quantity (e.g., 30, 60, 90 etc.) of pharmaceuticals.

SUMMARY

In one aspect, a hopper of a pharmaceutical counter, the hopper comprises a housing having an upper portion and a lower portion. The housing defines an interior sized to hold a plurality of pharmaceuticals. The interior has a lower end and an upper end. The lower portion of the housing defining an outlet in communication with the interior. The outlet sized and shaped to permit the plurality of pharmaceuticals to move therethrough. A baffle is supported by the housing and is disposed in the interior. The baffle is disposed between the upper and lower ends of the interior. The baffle is arranged to support a portion of the plurality of pharmaceuticals above the baffle when the plurality of pharmaceuticals is held in the interior of the housing.

In another aspect, a method of installing a hopper in a pharmaceutical counter array is disclosed. The pharmaceutical counter array includes a plurality of pharmaceutical counters. The method may comprise removing an existing hopper from a first pharmaceutical counter of the plurality of pharmaceutical counters. The existing hopper has a first volume for holding pharmaceuticals. The method may also comprise removing a second pharmaceutical counter of the plurality of pharmaceutical counters from the pharmaceutical counter array. The second pharmaceutical counter is disposed directly above the first pharmaceutical counter in the pharmaceutical counter array. The method may also comprise installing the hopper in the first pharmaceutical counter. The hopper has a second volume for holding pharmaceuticals. The second volume is greater than the first volume. After being installed, the hopper occupies at least a portion of a space previously occupied by the second pharmaceutical counter in the pharmaceutical counter array before the second pharmaceutical counter was removed from the pharmaceutical counter array.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
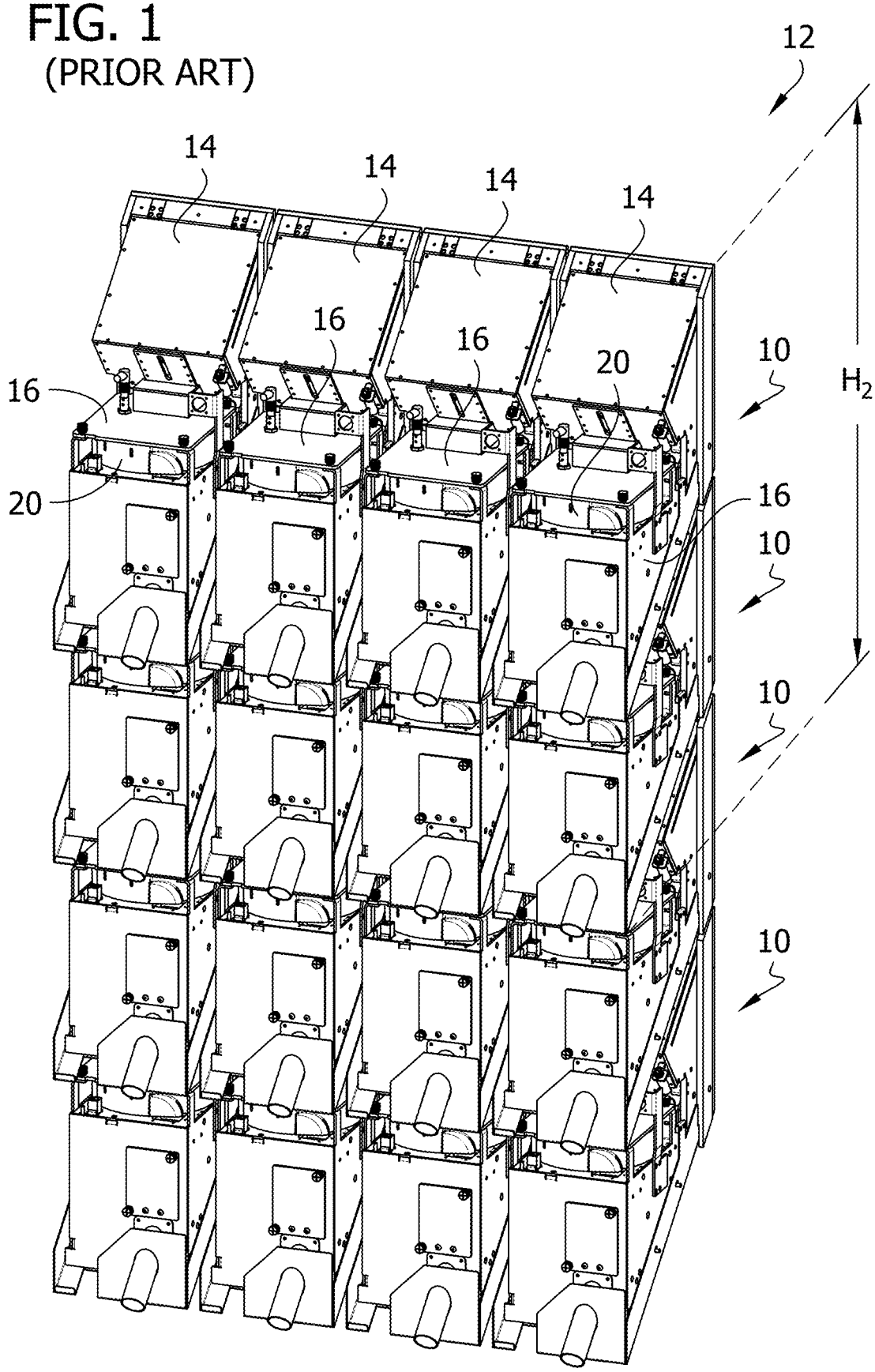
FIG. 1 (PRIOR ART)
FIG. 1 is a perspective of a plurality of pharmaceutical counters arranged in an array.
Figure 2:
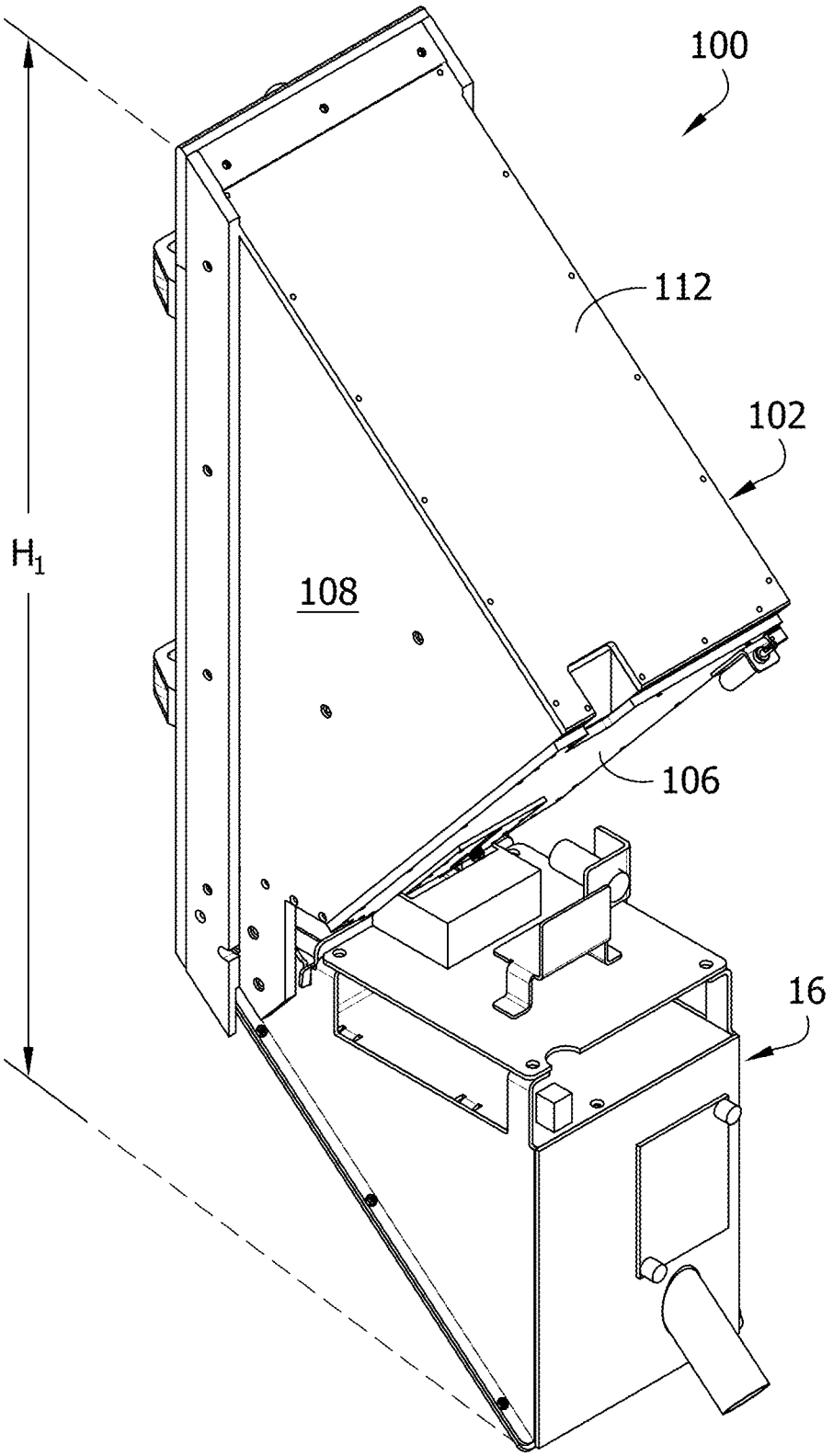
FIG. 2 is a rear perspective of a hopper according to one embodiment of the present disclosure that is part of a pharmaceutical counter of one of the pharmaceutical dispensers.
Figure 3:
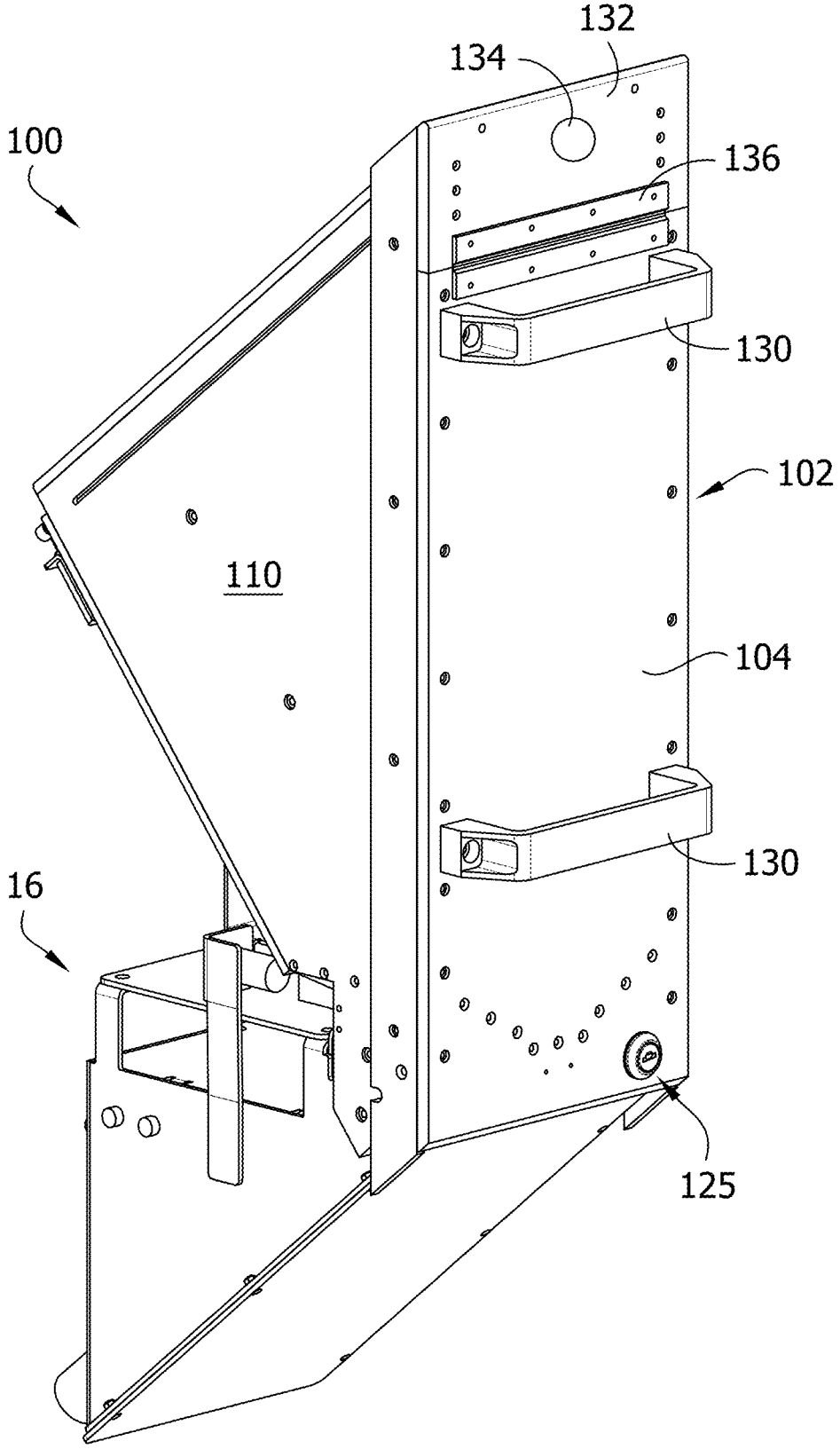
FIG. 3 is a front perceptive thereof.

The systems and methods described herein relate to automated dispensing systems, such as high volume fillers, of pharmaceutical fulfillment systems, such as a high volume pharmaceutical order processing systems, to fulfill a prescription order received by the pharmaceutical order processing system by supplying specified quantities of pharmaceuticals to prescription containers. Further details on pharmaceutical order processing systems, automated dispensing systems, pharmaceutical dispensers and components thereof may be found in U.S. Pat. Nos. 10,303,854 and 9,697,335, the entireties of which are hereby incorporated by reference. Referring to FIG. 1, such automated dispensing systems typically have a plurality of pharmaceutical counters 10 (e.g., counting cells) configured to count and dispense (e.g., release) the exact number of pharmaceuticals needed to fill a prescription order. The prescription order may include one or more pharmaceuticals. The pharmaceuticals dispensed by the pharmaceutical counters 10 may be in the form of pills, capsules, geltabs, tablets, or the like. The plurality of pharmaceutical counters 10 are typically arranged in one or more arrays or banks 12 (e.g., pharmaceutical counter array), such as the one shown in FIG. 1. In the illustrated embodiment, an array 12 arranged in a 4×4 grid containing sixteen pharmaceutical counters 10 is generally shown. It is understood an array can have more or fewer pharmaceutical counters 10 and can have other arrangements of the pharmaceutical counters. Each pharmaceutical counter counts and dispenses a single type of pharmaceutical to avoid cross contamination with other pharmaceuticals. Accordingly, the more pharmaceutical counters 10 an automated dispensing system has, the greater the number of different types of pharmaceuticals the automated dispensing system can dispense. To this end, the array 12 maximizes the number of pharmaceutical counters 10 that can fit in a given space. All the pharmaceuticals counters 10 in the array 12 shown in FIG. 1 are identical.

Figure 4:
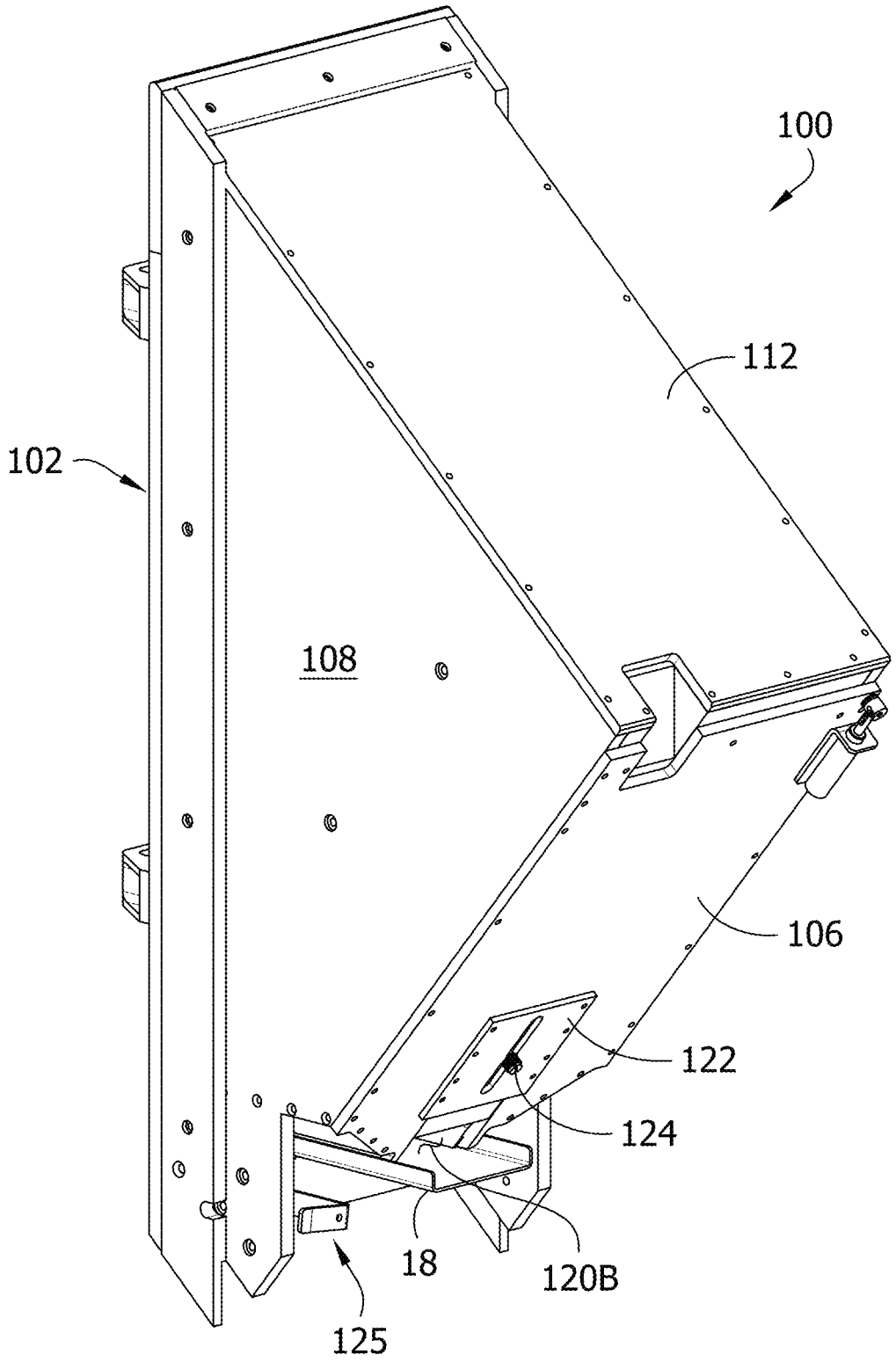
FIG. 4 is a rear perspective of the hopper.
Figure 5:
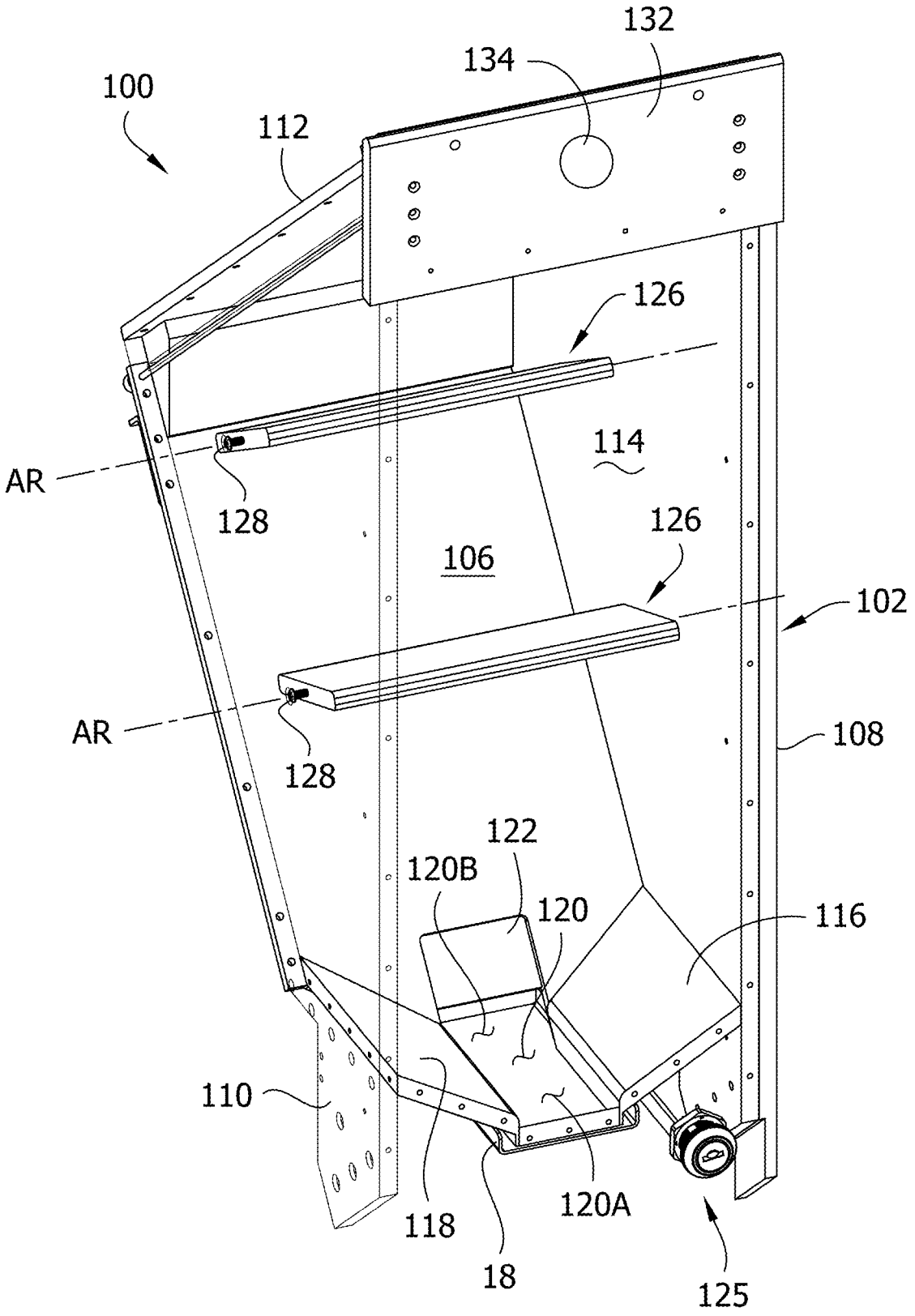
FIG. 5 is a front perspective of the hopper with components thereof hidden from view or made transparent to reveal interior details.

Each pharmaceutical counter 10 is configured to count and release a specified quantity (e.g., exact counts) of pharmaceuticals (or other plurality of individual solids) to fulfill a prescription order. The pharmaceutical counter 10 includes a conventional hopper 14 and a counting mechanism 16. The conventional hopper 14 is configured to store a plurality of pharmaceuticals for the counting mechanism. The counting mechanism 16 is configured to count and release the exact number of pharmaceuticals needed to fill a prescription order. The conventional hopper 14 has an interior volume of about 4 liters (about 1 gallon). This capacity allows the conventional hopper 14 to hold, on average, approximately 4000 pills or generally all the pharmaceuticals contained in one replenishment container. Of course this number can vary depending on the size of the pills. During operation, the convention hopper 14 generally hold enough pharmaceuticals for about thirty minutes of runtime. Thus, an operator or pharmacists must refill the conventional hopper 14 approximately every thirty minutes. Pharmaceuticals counters 10 are generally known and thus a more detailed description herein is omitted. For example, the pharmaceutical counters 10 shown in FIG. 1 are Kirby Lester High Volume Counting Cells, although other counters are within the scope of the present disclosure. These pharmaceutical counters 10 have a counting mechanism 16 that includes vibratory plate 18 (FIG. 4) that feeds a rotating, vibratory feed bowl 20 with pharmaceuticals from the conventional hopper 14. The feed bowl facilitates the singulation or individualization and counting of the pharmaceuticals. Other types of pharmaceutical counters and counting mechanisms are within the scope of the present disclosure.

Referring to FIGS. 2-6, a hopper according to an embodiment of the present disclosure is generally indicated at 100. The hopper 100 is configured to replace the conventional hopper 14 of a pharmaceutical counter 10. The hopper 100 includes a housing 102 having an upper portion (e.g., upper end) and a lower portion (e.g., lower end). The housing 102 includes a vertical front wall 104, an angled rear wall 106, opposite vertical first and second side walls 108, 110, and an angled upper wall 112. The housing 102 also includes angled first and second bottom walls 116, 118. The housing 102 defines an interior 114 sized to hold a plurality of pharmaceuticals. The interior 114 has an upper portion (e.g., upper end) and a lower portion (e.g., lower end). The upper wall 112 generally defines the upper portion of the interior 114 and the first and second bottom walls 116, 118 generally define the lower portion of the interior. The first and second side walls 108, 110 define opposite first and second sides of the interior 114. The walls enclose an interior volume (i.e., the interior 114) in which the pharmaceuticals can be stored. As described at least one wall is vertically oriented, e.g., the front wall, a first side wall or a second side wall. At least one wall is angled relative to vertical and to horizontal, e.g., the upper wall 112 or the rear wall 106. The other of the wall 112 or 106 could be vertically oriented in an example embodiment. The hopper 100 is an irregular polyhedron, e.g., a triangular prism, in an example embodiment.

The interior 114 has a volume that is larger than the volume of the conventional hopper 14 and preferably much larger than the volume of the conventional hopper, e.g., at least double. In various embodiments, the volume of the interior 114 is 3×, 4×, 5×, 6×, 7×, etc. the volume of the conventional hopper 14. The volume of the interior 114 is preferably within the inclusive range of about 12 liters (about 3.2 gallons) to about 28 liters (about 7.4 gallons), and more preferably within the inclusive range of about 16 liters (about 4.2 gallons) to about 24 liters (about 6.3 gallons), and more preferably within the inclusive range of about 16 liters (about 4.2 gallons) to about 20 liters (about 5.3 gallons), and more preferably about 18 liters (about 4.8 gallons). Thus, the hopper 100 of the present disclosure is able to hold more pharmaceuticals than the conventional hopper 14. For example, a hopper 100 of the present disclosure with a volume of about 18 liters can hold approximately 20,000 pharmaceuticals or all the pharmaceuticals contained in five to six replenishment containers. The larger volume of the hopper 100 of the present disclosure enables the automated dispensing system to be more efficient, by reducing the frequency the hopper 100 need to be refilled compared to the conventional hopper 14. This also reduces the pharmaceutical counter's 10 downtime (e.g., the time the pharmaceutical counter is inactive or unable to dispense pharmaceuticals because the hopper needs to be or is being refilled). Moreover, because of the lower amount of downtime, it is easier for a control system of the pharmaceutical order processing systems to schedule and arrange the fulfillment of prescription orders using the pharmaceutical counter 10 having the hopper 100 of the present disclosure. Accordingly, a pharmaceutical counter 10 having the hopper 100 of the present disclosure has less downtime and is therefore more likely to be ready to dispense pharmaceuticals when needed to fill prescription orders.

The lower portion of the housing 102 defines an outlet 120 in communication with the interior 114 (e.g., the lower portion of the interior). The outlet 120 is sized and shaped to permit pharmaceuticals held in the interior 114 of the hopper 100 to move therethrough. Specifically, the outlet 120 permits pharmaceuticals to flow toward the counting mechanism 16. In the illustrated embodiment, the outlet 120 includes a first or horizontal portion 120A generally defined between the first and second bottom walls 116, 118, and a second or inclined portion 120B extending generally upward from an end of the horizontal portion. The second portion 120B of the outlet 120 is generally defined by the rear wall 106. The hopper 100 may also include a gate 122 which may also define an upper end of the second portion 120B of the outlet 120, as illustrated. The gate 122 can be selectively raised and lowered to control the size (e.g., height) of the second portion 120B of the outlet 120. Raising and lowering the gate 122 permits an operator to conform the outlet 120 to different sizes of pharmaceuticals and control the flow rate of the pharmaceuticals therefrom to the counting mechanism 16. The hopper 100 includes a gate actuator 124 to selectively fix the gate 122 in position. In the illustrated embodiment, the gate actuator 124 comprises a thumb screw that can be selectively tightened and loosened to move the gate 122.

The housing 102 mounts on the counting mechanism 16 of the pharmaceutical counter 10. Preferably, the housing 102 has the same mounting arrangement (e.g., arrangement of fastener openings) as the conventional hopper 14 so that the hopper 100 of the present disclosure can simply replace the conventional hopper. However, specialized counter mounts may be used to attach the hopper 100 to a counting mechanism. The hopper 100 may also include a lock 125 to secure the hopper 100 to the counting mechanism 16. When the hopper 100 is attached to the counting mechanism 16, the vibratory plate 18 of the counting mechanism underlies the horizontal portion 120A of the outlet 120. In operation, the counting mechanism 16 vibrates the vibratory plate 18. As a result, pharmaceuticals at the lower end of the interior 14 move rearward, along the vibratory plate 18, out through the second portion 120B of the outlet 120 and toward the vibratory bowl 20.

The hopper 100 includes two handles 130 mounted on the front wall 104. The handles 130 permit an operator to easily remove or mount the hopper to the counting mechanism 16. The hopper 100 also includes a door 132 with a knob 134 in the front wall 104 to permit the operator to fill the interior 114 with the pharmaceuticals. A hinge 136, about which the door 132 pivots between open and closed positions, connects the door to the remainder of the front wall 104.

The hopper 100 includes one or more supports or baffles 126 disposed in the interior 114 of the housing 102. In the illustrated embodiment, the hopper 100 includes two baffles 126, although more or fewer baffles are within the scope of the present disclosure. Each baffle 126 is arranged to support a portion of the plurality of pharmaceuticals held in the interior 114 of the housing 102. By supporting a portion of the pharmaceuticals in the interior 114, each baffle 126 reduces the head pressure of the pharmaceuticals at the outlet 120. Through development of the hopper 100 of the present disclosure, it was unexpectedly discovered that the volume of the conventional hopper 14 could not simply be increased to hold more pharmaceuticals. The pharmaceuticals would not flow properly along the vibratory plate and/or would block or become jammed at the outlet. It was determined that the greater weight of the larger quantity of pharmaceuticals overwhelmed the vibratory plate 18 of the counting mechanism 16 and prevented the vibratory plate from functioning properly—i.e., moving the pharmaceuticals from the hopper to vibratory bowl 20 to feed the counting mechanism. Due to the greater weight or head pressure of the larger quantity of pharmaceuticals, the pharmaceuticals would clump together and block the outlet of the conventional hopper. In addition, some pharmaceuticals are dusty in nature, which further facilitates the clumping of the pharmaceuticals together. This clumping due to dust can also be exacerbated under certain temperature and/or humidity conditions. The baffles 126 of the present disclosure relieve or lower the head pressure of the pharmaceuticals at the outlet 120, thereby preventing the pharmaceuticals from blocking the outlet and permitting the vibratory plate 18 to function as intended (i.e., to move the pharmaceuticals in the hopper 100 through the outlet 120 toward the vibratory bowl 20).

Figure 6:
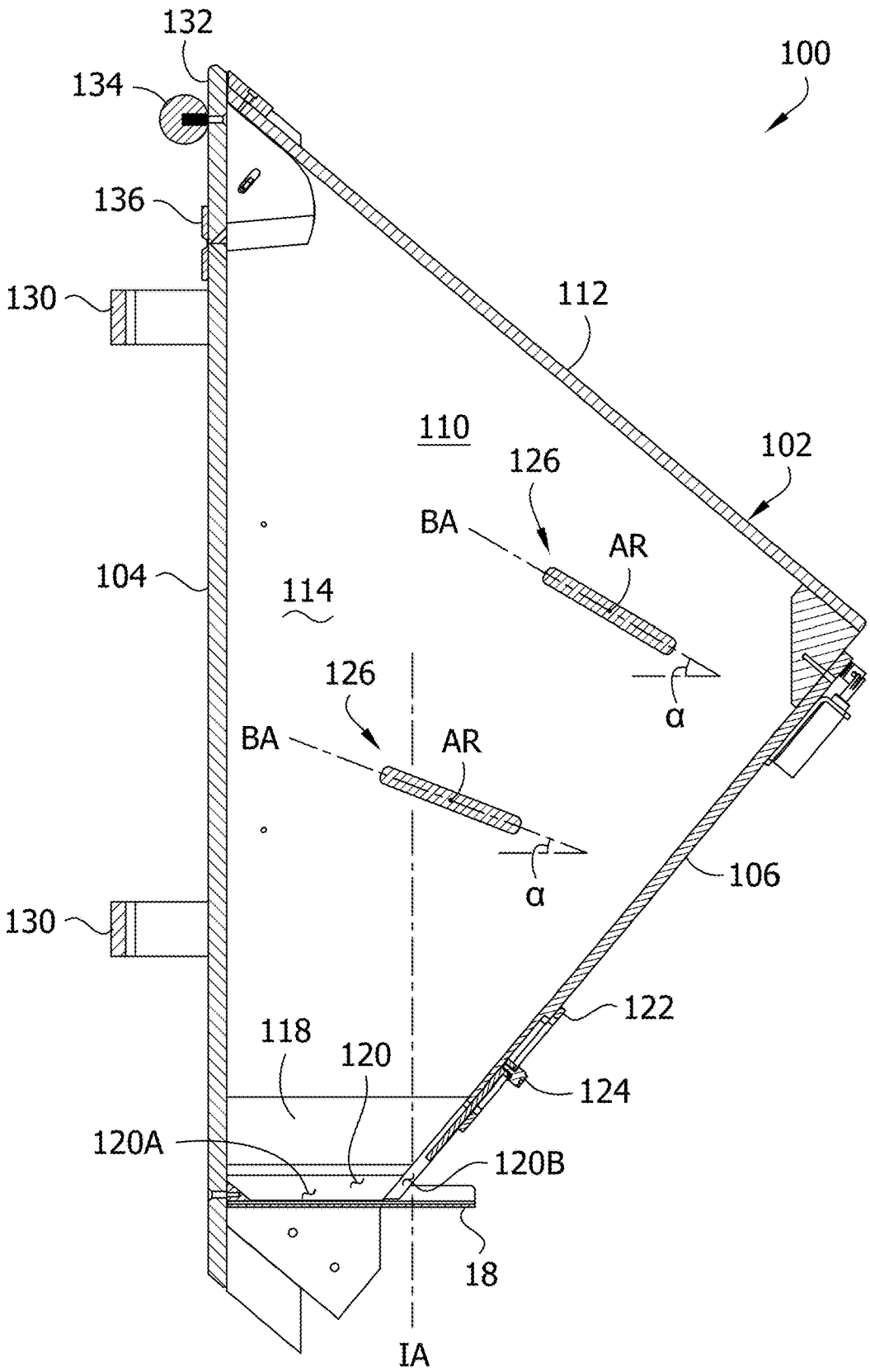
FIG. 6 is a cross section of the hopper.

Each baffle 126 is generally identical in the illustrated embodiment, but mounted in different locations within the interior 114. Accordingly, one baffle 126 will now be discussed with the understanding the description applies to the other baffle. The baffle 126 is supported by the housing 102. Specifically, the baffle 126 is mounted to the housing 102. The baffle 126 extends between the first and second side walls 108, 110. The baffle 126 is disposed between the upper and lower ends of the interior 114. This arrangement allows the baffle 126 to support a portion of the pharmaceuticals in the interior 114. As shown in FIG. 6, the baffle 126 is preferably spaced apart from the front and rear sides of the interior 114. This permits the pharmaceuticals to flow freely around the front and rear of the baffle toward the outlet 120. The baffle 126 has a generally planar shape, with opposite upper and lower planar faces. The baffle 126 has a front side or edge and a rear side or edge and a baffle axis BA extending between the front and rear sides. The baffle axis BA is disposed at an angle $\alpha$ to a horizontal plane. The baffle 126 is preferably sloped or angled toward the rear wall 106 of the housing 102. This directs the pharmaceuticals toward the angled rear wall 106, which also supports the pharmaceuticals. Preferably, the angle $\alpha$ is within the inclusive range of about 20 degrees to about 60 degrees. Such a range balances the baffle's 126 need to provide support for the pharmaceuticals while also ensuring the pharmaceuticals do not remain on the baffle (as would be the case if the angle $\alpha$ what zero or close thereto). Such a range also balances the baffle's 126 need to provide support for the pharmaceuticals while also minimizing a void in the pharmaceuticals immediate underneath the baffle. This void space can be created when the pharmaceuticals are poured into the interior 114 of the hopper 100. As the pharmaceuticals are poured, the pharmaceuticals flow around the baffle 126 and therefore are not able to flow up to the underside of the baffle. The void space reduces the amount of pharmaceuticals the interior 114 of the hopper 100 can hold.

In the illustrated embodiment, the baffle 126 is movable relative to the housing 102. In particular, the baffle is pivotable or rotatable about an axis of rotation AR. This allows the angle $\alpha$ of the baffle 126 to be changed. Changing the angle $\alpha$ of the baffle 126 enables the orientation of the baffle to be set for the size of pharmaceuticals the hopper 100 will receive. For example, the angle $\alpha$ can be adjusted so that for any given type of pharmaceutical, the baffle 126 will provide sufficient support while minimizing the amount of void space. Also, changing the angle $\alpha$ of the baffle 126 can change the amount of support the baffle provides, which may be necessary depending upon how dusty the pharmaceuticals are. The hopper 100 includes one or more retainers 128 (FIG. 5) configured to selectively fix the baffle 126 relative to the housing 102. Actuating the one or more retainers 128 in one direction permits the baffle to be moved relative to the housing and actuating the one or more retainers in another (e.g., opposite) direction secures the baffle in position relative to the housing. In the illustrated embodiment, each retainer 128 comprises a fastener (e.g., a screw) that can be selectively rotated to be loosened or tightened to permit the baffle to move or secure the baffle in place, respectively. In the illustrated embodiment, the fastener also mounts the baffle 128 to one of the side walls 108, 110 and defines the axis of rotation AR. Movement of the retainers 128 may also move the baffle 126. Other ways of mounting and securing the baffles to the housing are within the scope of the present disclosure.

In the illustrated embodiment, the baffle 126 has a generally rectangular shape, although other shapes (e.g., oval) are within the scope of the present disclosure. In one embodiment, the baffle 126 may include (e.g., define) openings or slots extending therethrough. The openings or slots permit some of the pharmaceuticals to fall therethrough to minimize or eliminate the void the baffle 126 can create, thereby maximizing the holding capacity of the hopper 100. In this embodiment, the openings or slots are as small as possible (e.g., slightly larger than the size of the pharmaceuticals) while still permitting pharmaceuticals to pass therethrough in order to still be able to provide support for other pharmaceuticals above the baffle 126.

Referring to FIG. 6, in the illustrated embodiment, the hopper 100 includes two baffles 100. One of the baffles 126 (e.g., a first baffle) is arranged relative to the outlet 120 such that an imaginary vertically-oriented axis IA intersects both the outlet and the baffle. Such an arrangement is preferable because it ensures at least a portion of the baffle 126 is disposed directly above the outlet 120, thereby providing a greater reduction of head pressure at the outlet. Even more preferably, the at least one baffle 126 is arranged such that the imaginary axis IA intersections the second portion 120B of the outlet 120 (broadly, the portion of the outlet the pharmaceuticals flow through as they move along the vibratory plate 18 and toward the vibratory bowl 20). The other baffle 126 (e.g., a second baffle) is preferably horizontally and vertically offset from the first baffle. In the illustrated embodiment, the second baffle 126 is disposed upward and rearward of the first baffle. Other positions are within the scope of the present disclosure. For example, it is understood the baffles can be disposed at any position within the interior 114 of the hopper 100. In an example embodiment, the first, lower baffle 126 is positioned essentially at the coronal plane and at or below the transverse plane of the hopper 100 when viewed from the front where the handles 130 are positioned. The second, upper baffle 126 is positioned behind the coronal plane (rearwardly of the first, lower baffle) and above the transverse plane of the hopper 100 and above the first, lower baffle. In an example, all of the baffles are positioned rearwardly of the center plane of the interior. In an example, one baffle overlaps the center plane. The center plane can be defined by splitting the interior into equivalent front and rear halves. In an example embodiment, the first and second baffles 126 are horizontally offset such that they do not vertically overlap one another (e.g., a single imaginary vertical axis does not extend through both baffles). In an example embodiment, the first and second baffles are positioned relative to one another such that the rear end of the first baffle and the front end of the second baffle are vertically aligned, such as when the angle $\alpha$ of the first and second baffles is zero (e.g., the first and second baffles are oriented horizontally) or when the first and second baffles are set at the desired angle $\alpha$ for a type of pharmaceutical. In an example embodiment, the first and second baffles are positioned to overlay the angled wall (e.g., wall 106) of the housing 102. In an example embodiment, the front end of the first, lower baffle 126 is disposed forwardly of the front-most portion of the second portion 120B of the outlet 120 when the baffle is oriented horizontally, or more preferably, when the baffle is oriented at the desired angle $\alpha$ for a type of pharmaceutical. Likewise, in an example embodiment, the rear end of the first, lower baffle 126 is disposed rearwardly of the rear-most portion of the second portion 120B of the outlet 120 when the baffle is oriented horizontally, or more preferably, when the baffle is oriented at the desired angle $\alpha$ for a type of pharmaceutical. Accordingly, in an example embodiment, the first, lower baffle 126 overlays the entire second portion 120B of the outlet 120.

In one embodiment, the hopper 100 may include a kit of baffles with different widths. The kit can include multiple sets of two or more baffles having the same width. This allows an operator to select the baffle(s) with the smallest possible width that will still provide a sufficient amount of support for a given size of pharmaceutical. This allows the operator to select a baffle size that will minimize the void space. Such selected baffles can be installed in the interior 114 of the housing 102. To interchange or replace the baffles 126, the operator can disconnect one of the walls of the housing 102 (such as the front wall 104 or upper wall 112), unscrew the fasteners from the existing baffles, secure the fasteners to the replacement baffles and then reconnect the disconnected wall of the housing. The baffles 126 can have a mate at one end that removably attaches to a non-removable wall of the housing 102 and a fastener to fix the baffle to the removable wall. The fastener can be removed to separate the baffle 126 from the removable wall when changing the baffle for a different size baffle. In an example embodiment, the baffles in the kit all have a same length to extend from the removable side wall to the fixed, non-removable side wall.

Figure 7:
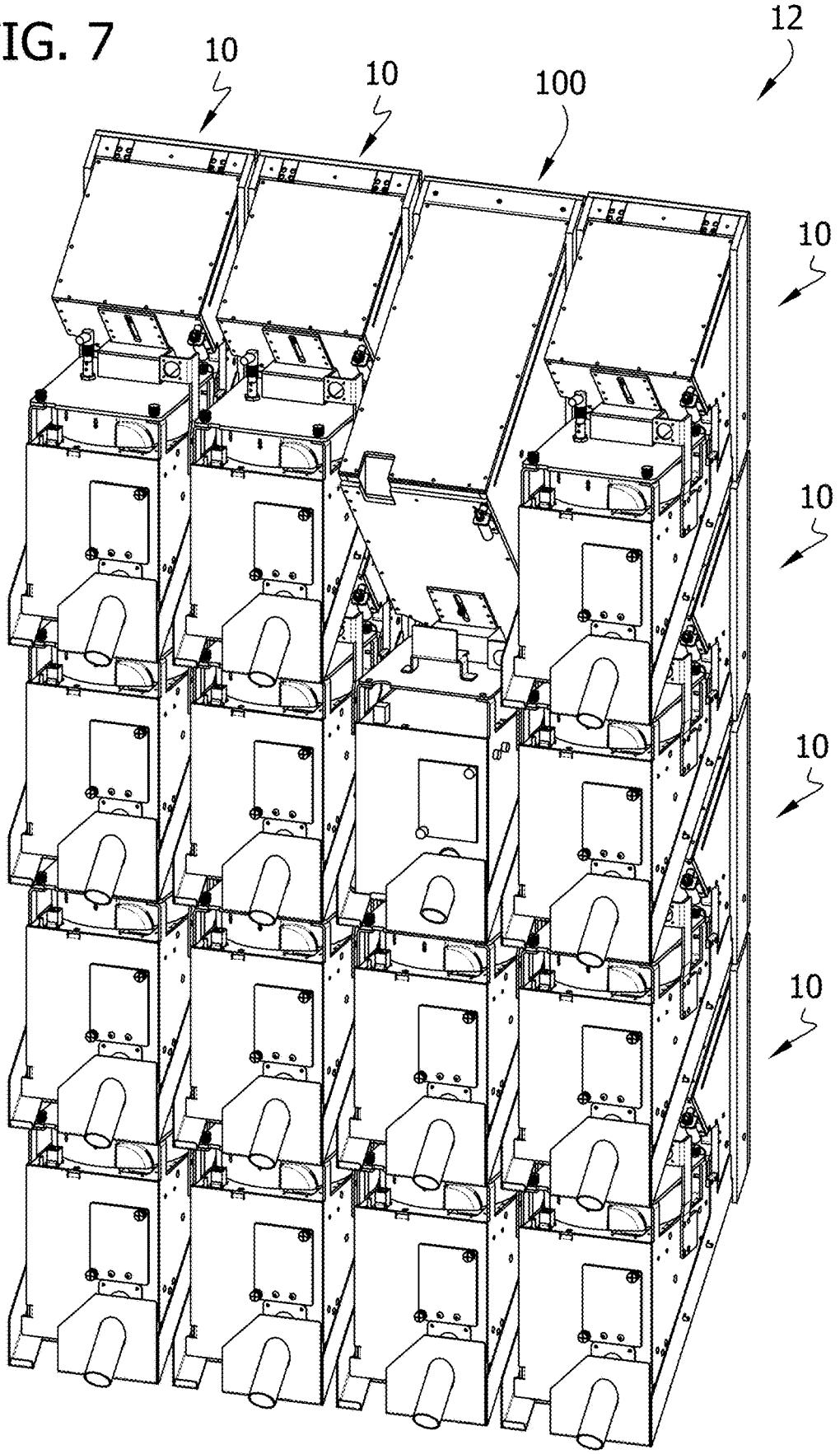
FIG. 7 is a perspective of the array of FIG. 1 with one of the pharmaceutical counters including the hopper of FIG. 2.
Figure 8:
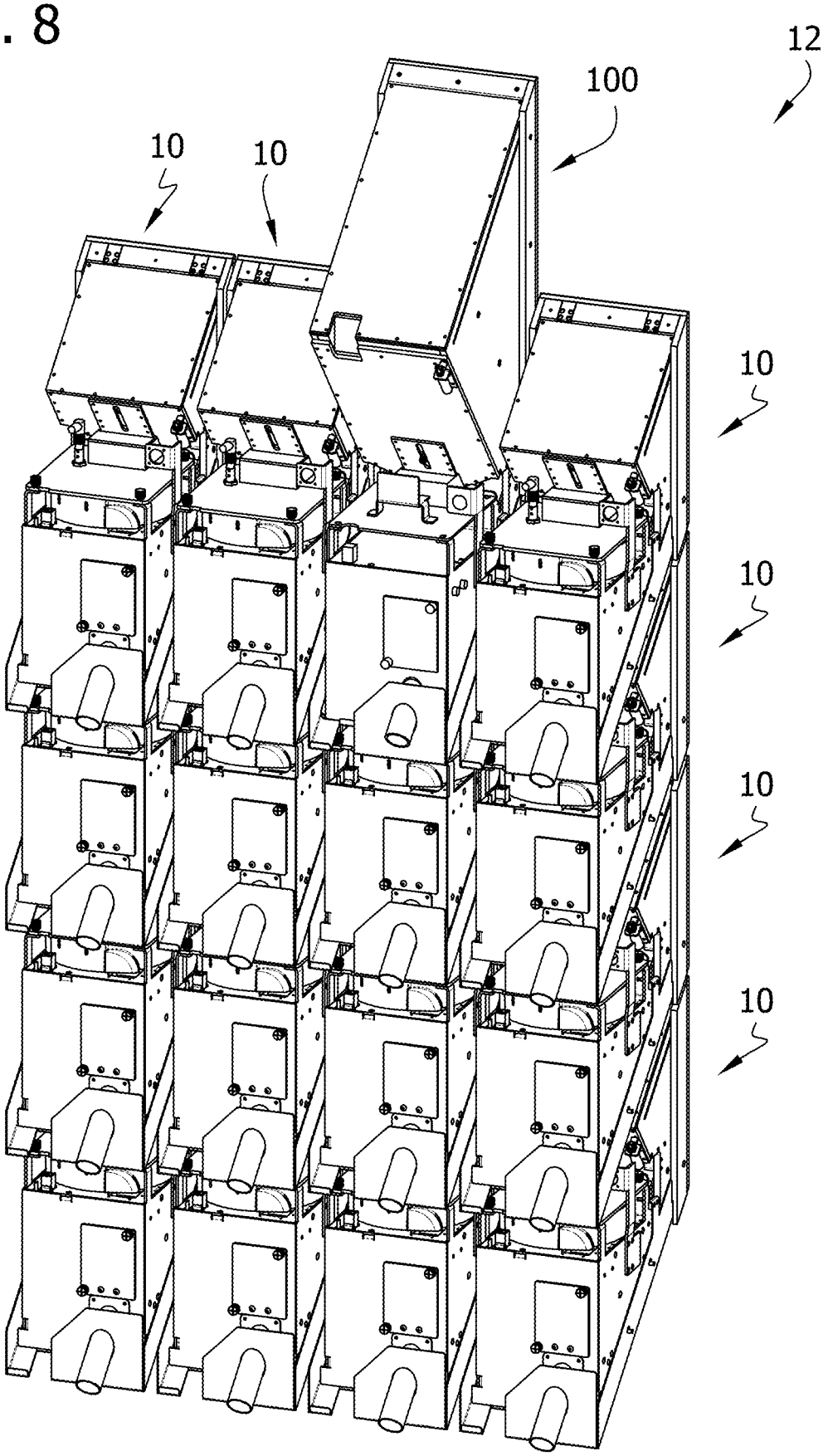
FIG. 8 is a perspective of the array of FIG. 1 with another one of the pharmaceutical counters including the hopper of FIG. 2.

As shown in FIGS. 7 and 8, the hopper 100 of the present disclosure can be used with any pharmaceutical counter 10 in the array 12. For example, in FIG. 7, the hopper 100 is mounted to the counting mechanism 16 of the pharmaceutical counter 10 located in the third column from the left and in the second row from the top of the array 12 (e.g., at position 3×2 in the array). In FIG. 8, the hopper 100 is mounted to the counting mechanism of the pharmaceutical counter 10 located in the third column from the left and in the top row of the array 12 (e.g., at position 3×1 in the array).

Referring to FIG. 7, in operation, the hopper 100 may replace one of the pharmaceutical counters 10 in the array 12. In this case, the hopper 100 occupies at least a portion of the space in the array 12 previously occupied by the pharmaceutical counter 10 the hopper replaced. Preferably, at illustrated, the hopper 100 substantially fills the space previously occupied by the pharmaceutical counter 10 the hopper replaced. Accordingly, the housing 102 of the hopper 100 is sized and shaped to correspond to the size and shape of the pharmaceutical counter 10. For example, the hopper 100 as a width that is generally the same as or corresponds to the width of the conventional hopper 14. The slope of the upper wall 112 of the housing 102 generally matches the slope of the bottom side of the pharmaceutical counter 10. Likewise, the depth of the housing 102 generally matches the depth of the pharmaceutical counter 10. These characteristics allow the hopper 100 to be added to the array 12 by taking the place of an existing pharmaceutical counter 10 (FIGS. 7 and 8), while also maximizing the holding capacity of the hopper.

Referring to FIG. 7, in one method of installing the hopper 100 in the array 12, the operator removes the conventional or existing hopper 14 of the pharmaceutical counter 10 (e.g., a first pharmaceutical counter) the operator desires to replace with the hopper of the present disclosure. In this case, the operator removes the conventional hopper 14 of the pharmaceutical counter 10 at position 3×2 in the array 12. The operator also removes the pharmaceutical counter (e.g., a second pharmaceutical counter) that is disposed directly above the first pharmaceutical counter from the array 12. In this case, the operator removes the pharmaceutical counter 10 at position 3×1 in the array 12. Removing the conventional hopper 14 and the second pharmaceutical counter 10 can happen in any order or generally simultaneously. After, the operator installs the hopper 100 of the present disclosure in the first pharmaceutical counter 10. The operator mounts the hopper 100 on the counting mechanism 16 of the first pharmaceutical counter 10. As shown in FIG. 7, the hopper 100 substantially fills the space in the array 12 previously occupied by the second pharmaceutical counter 10. The first pharmaceutical counter has a first height $H_1$ (FIG. 2) extending between the upper end of the hopper 100 and a lower end of the first pharmaceutical counter that is generally equal to or less than a second height $H_2$ (FIG. 1) extending between the upper end of the second pharmaceutical counter and the lower end of the first pharmaceutical counter. Before, during, or after the installation process for the hopper 100, the operator can adjust (e.g., rotate about the axis of rotation AR) the position (e.g., angle $\alpha$) one or both of the baffles 126 of the hopper to position the baffles to adequately support the type (e.g., size) of pharmaceutical the hopper will hold. The angle $\alpha$ of the baffles 126 can be the same or different.

Referring to FIG. 8, in another method of installing the hopper 100 in the array 12, the operator installs the hopper on one the pharmaceutical counters on the top row of the array. In this situation, the process is generally the same as described above in relation to FIG. 7, except that the operator does not have to remove a pharmaceutical counter 10 to accommodate the hopper 100.

The present description discloses embodiments in detail directed to, e.g., systems and methods relating to automated dispensing systems operating on pharmaceuticals. These embodiments can be extending to operate with non-pharmaceuticals, e.g., individual, solid forms that can be counted and dispensed into containers like pills, capsules, geltabs, tablets, or the like. Some forms are non-flowable individual items. Some forms can include health supplements, candy, and the like.

As mentioned herein, during development of the presently disclosed hopper, it was found that merely enlarging the size of the prior hopper did not work properly as merely enlarging did not work in the automated dispensing systems and introduced variations in pill dispensing. The present inventor worked to discover a hopper to address the drawbacks of the prior hopper.

It is appreciated that the systems and components described herein can be used in other contexts without departing from the scope of the present disclosure.

It is appreciated that the person of ordinary skill in the art is readily able to determine the scope of terms of degree such as, but not limited to, "about," "substantially," and "generally." For example, when a term of degree is used in relation to a numeric value, the person of ordinary skill in the art understands that the term of degree covers an inclusive range of plus or minus 10% of the numeric value, unless clearly indicated or stated otherwise.

The Title, Field, and Background are provided to help the reader quickly ascertain the nature of the technical disclosure. They are submitted with the understanding that they will not be used to interpret or limit the scope or meaning of the claims. They are provided to introduce a selection of concepts in simplified form that are further described in the Detailed Description. The Title, Field, and Background are not intended to identify key features or essential features of the claimed subject matter, nor is it intended to be used as an aid in determining the claimed subject matter.

When introducing elements of aspects of the disclosure or the embodiments thereof, the articles "a," "an," "the," and "said" are intended to mean that there are one or more of the elements. The terms "comprising," "including," and "having" are intended to be inclusive and mean that there may be additional elements other than the listed elements.

In view of the above, it will be seen that several advantages of the aspects of the disclosure are achieved and other advantageous results attained.

Not all of the depicted components illustrated or described may be required. In addition, some implementations and embodiments may include additional components. Variations in the arrangement and type of the components may be made without departing from the spirit or scope of the claims as set forth herein. Additional, different or fewer components may be provided and components may be combined. Alternatively or in addition, a component may be implemented by several components.

The above description illustrates the aspects of the disclosure by way of example and not by way of limitation. This description enables one skilled in the art to make and use the aspects of the disclosure, and describes several embodiments, adaptations, variations, alternatives and uses of the aspects of the disclosure, including what is presently believed to be the best mode of carrying out the aspects of the disclosure. Additionally, it is to be understood that the aspects of the disclosure is not limited in its application to the details of construction and the arrangement of components set forth in the description or illustrated in the drawings. The aspects of the disclosure are capable of other embodiments and of being practiced or carried out in various ways. Also, it will be understood that the phraseology and terminology used herein is for the purpose of description and should not be regarded as limiting.

Having described aspects of the disclosure in detail, it will be apparent that modifications and variations are possible without departing from the scope of aspects of the disclosure as defined in the appended claims. It is contemplated that various changes could be made in the above constructions, products, and methods without departing from the scope of aspects of the disclosure. In the preceding specification, various embodiments have been described with reference to the accompanying drawings. It will, however, be evident that various modifications and changes may be made thereto, and additional embodiments may be implemented, without departing from the broader scope of the aspects of the disclosure as set forth in the claims that follow. The specification and drawings are accordingly to be regarded in an illustrative rather than restrictive sense.

What is claimed is:

1. A method of installing a hopper in a pharmaceutical counter array, the pharmaceutical counter array including a plurality of pharmaceutical counters, the method comprising:

removing an existing hopper from a first pharmaceutical counter of the plurality of pharmaceutical counters, the existing hopper having a first volume for holding pharmaceuticals;

removing a second pharmaceutical counter of the plurality of pharmaceutical counters from the pharmaceutical counter array, the second pharmaceutical counter disposed directly above the first pharmaceutical counter in the pharmaceutical counter array; and installing the hopper in the first pharmaceutical counter, the hopper having a second volume for holding pharmaceuticals, the second volume being greater than the first volume;

wherein the hopper occupies at least a portion of a space previously occupied by the second pharmaceutical counter in the pharmaceutical counter array before the second pharmaceutical counter was removed from the pharmaceutical counter array.

2. The method of claim 1, wherein the hopper substantially fills the space previously occupied by the second pharmaceutical counter.

3. The method of claim 1, wherein the hopper as a width generally corresponding to a first width of the existing hopper, and wherein the first pharmaceutical counter has a first height extending between an upper end of the hopper and a lower end of the first pharmaceutical counter after the said installing the hopper, the first height generally equal to or less than a second height, the second height extending between an upper end of the second pharmaceutical counter and the lower end of the first pharmaceutical counter before said removing the second pharmaceutical counter.

4. The method of claim 1, wherein said installing the hopper includes adjusting a position of a baffle of the hopper.

5. The method of claim 4, wherein said adjusting includes rotating the baffle about an axis of rotation.

6. The method of claim 4, wherein the baffle is a first baffle, and wherein said installing the hopper includes adjusting a position of a second baffle of the hopper.

7. The method of claim 4, further comprising positioning a gate disposed at an outlet of the hopper to adjust a size of the outlet to control a flow of the pharmaceuticals therethrough with the outlet of the hopper is opened horizontally, and positioning the baffle is above the outlet.

8. The method of claim 1, further comprising positioning a gate disposed at an outlet of the hopper to adjust a size of the outlet to control a flow of the pharmaceuticals therethrough.

9. The method of claim 1, wherein the housing has an upper portion and a lower portion defining an interior sized to hold the pharmaceuticals, the interior having a lower end and an upper end, the lower portion of the housing defining an outlet in communication with the interior, the outlet sized and shaped to permit the pharmaceuticals to move therethrough into a counter associated with the first pharmaceutical counter and not the second pharmaceutical counter; and a baffle disposed between the upper and lower ends of the interior arranged to support a portion of the pharmaceuticals above the baffle when the pharmaceuticals are held in the interior of the housing, and positioning the baffle to reduce pressure of the plurality of pharmaceuticals at the outlet.

10. The method of claim 9, wherein positioning the baffle includes positioning the baffle to be spaced apart from front and rear sides of the interior.

11. The method of claim 9, further comprising positioning the baffle relative to the outlet such that an imaginary vertically-oriented axis intersects the baffle and the outlet.

12. The method of claim 9, with the baffle having a front side, a rear side and a baffle axis extending between the front and rear ends, disposing the baffle axis at an angle to a horizontal plane.

13. The method of claim 12, wherein disposing the baffle axis is at the angle within an inclusive range of about 20 degrees to about 60 degrees.

14. The method of claim 12, wherein disposing includes the baffle being movable relative to the housing to change the angle.

15. The method of claim 14, further comprising applying a retainer to selectively fix the baffle relative to the housing.

16. The method of claim 1, disposing a first baffle and a second baffle in the interior of the hopper such that the first baffle supports a first portion of the pharmaceuticals in the hopper and the second baffle supports a second portion of the pharmaceuticals in the hopper with at least part of the second portion of pharmaceuticals being different that the first portion of pharmaceuticals.

17. The method of claim 16, wherein disposing includes offsetting the second baffle horizontally and vertically from the first baffle in the hopper.

18. The method of claim 16, wherein disposing includes disposing the second baffle rearwardly and upwardly relative to the first baffle and above the outlet.

* * * * *